United States Patent [19]

Godsey

[11] 4,135,512

[45] Jan. 23, 1979

[54] MEDICATION DISPENSING CUP

[76] Inventor: David W. Godsey, 437 Poppy Pl., Mountain View, Calif. 94043

[21] Appl. No.: 787,865

[22] Filed: Apr. 15, 1977

[51] Int. Cl.[2] ..... A61J 7/00

[52] U.S. Cl. ..... 128/222; 206/217

[58] Field of Search ..... 128/222, 213; 206/216, 206/217

[56] References Cited

U.S. PATENT DOCUMENTS

| | | | |
|---|---|---|---|
| 442,698 | 12/1890 | Yates | 128/222 |
| 727,212 | 5/1903 | Scott | 128/222 X |
| 1,275,467 | 8/1918 | Poulalion | 128/222 |
| 1,543,209 | 6/1925 | Fulton | 128/222 |
| 3,302,644 | 2/1967 | Kennedy et al. | 128/222 |
| 3,669,001 | 6/1972 | Asen | 128/222 X |

FOREIGN PATENT DOCUMENTS

| | | | |
|---|---|---|---|
| 21842 of | 1895 | United Kingdom | 128/222 |
| 5787 of | 1906 | United Kingdom | 128/222 |

*Primary Examiner*—John D. Yasko

*Attorney, Agent, or Firm*—Limbach, Limbach & Sutton

[57] ABSTRACT

A cup for simultaneously dispensing dry medication along with liquid wherein the cup has a domed bottom portion joined to semicylindrical and flat sidewall portions and an apertured lid hinged along the upper edge of the flat sidewall portion so that it can be closed over the open end of the cup, the lid having a dry, medication support surface on the upper portion of the lid and adjacent to the aperture whereby the cup may be tilted to dispense fluid through the aperture in the lid over the medication and simultaneously wash the now wetted medication into the mouth of the recipient.

9 Claims, 9 Drawing Figures

MEDICATION DISPENSING CUP

BACKGROUND OF THE INVENTION

This invention pertains to a cup and more particularly to a cup for dispensing dry medication.

The psychological and physiological difficulties experienced by many persons in swallowing tablets or pills are well known. The usual method is to place the medication in the mouth or on the tongue with the fingers, and then to swallow the medication with the use of one or more mouthfuls of liquid. Many people, however, experience gagging or nausea during the time interval between placing the pills in the mouth and taking the drink of liquid to wash them down. To minimize the incidence of contamination, hospitals place the medication in a small paper cup which the patient should then use to transfer the tablets to the mouth, then drink the liquid from another cup. The necessity for dispensing the medication from stock to the small cup, transporting it to the patient while assuring positive identification, and supplying sufficient liquid in another container can be a time consuming function, and does nothing to overcome the difficulties the recipient may have ingesting the dosage.

To overcome some of these problems some prior art devices of this type utilize a cup in which a shelf or receptacle is positioned on the interior side of the wall of the cup for holding the medicine which is to be dispensed. See for example, U.S. Pat. Nos. 1,264,539; 1,275,467; 1,825,339; 2,276,678; 2,656,837; 2,919,694; 2,940,447; 3,331,369; 3,534,736 and 3,810,470. Such a shelf is sometimes provided with grooves or holes in order to let the fluid within the cup wash through the shelf and carry the medicine with it into the mouth of the recipient. One difficulty with such prior art devices is that the dry medication must be carefully placed upon the shelf or else it will be accidentally dropped into the fluid resulting in a wastage of the medicine, since such medicine would not be palatable to the recipient at that point.

Still another problem is that such a shelf on the interior sidewall of the cup makes it difficult to stack or nest such cups in any great quantity, such as thirty or more.

Still a further problem is that the medicine must be placed on the shelf just before the cup is given to the recipient or else the jostling of the cup in delivering it to the patient may splash the liquid up onto the shelf and wet the medication. Also, there is the problem that liquid which has splashed onto the support shelf prior to the depositing of the medicine will cause the medicine to prematurely dissolve or stick to the shelf.

SUMMARY OF THE INVENTION

The above and other disadvantages of prior art medication dispensing cups are overcome by the present invention of the following improvements to the standard medication dispensing cup of the type having a bottom, a sidewall, and with the bottom and the sidewall being integrally joined together to constitute a fluid holding container which is open at its top. The improvements of the invention comprise a lid to cover the open top of the container, the lid having at least one aperture therein to allow the passage of fluid from the container therethrough and a dry, medication support surface on top of the lid and adjacent to the aperture. In the preferred embodiment of the invention, means are provided for mounting the lid on the open top of the container at a downward angle, when the cup is positioned vertically upright, so that the medication rests against the cup's sidewall as well as upon the upper surface of the lid.

In the preferred embodiment, the lid is hinged to the sidewall and in a particularly preferred embodiment, a portion of the sidewall is flat with the reaminder of the sidewall being semicylindrical. The lid is hinged to the upper edge of the flat portion of the sidewall. The semicylindrical portion of the sidewall which is diametrically opposed to the flat portion is extended to create a pouring spout which aids the recipient to drink the water and take medication from the cup.

The lid is provided with recesses along its outer edge on the side diametrically opposite from the hinged portion. The medication support surface is between the aperture and the recesses. This allows the patient or the nurse to pour the fluid from the cup in a manner so that the fluid simultaneously washes over the top of the medication and underneath it to effectively wet it and simultaneously flush it into the mouth of the recipient. In the preferred embodiment, means are provided for locking the lid in the downwardly angled position.

The sidewall portions of the preferred embodiment of the cup are tapered inwardly from the top toward the bottom to aid in stacking the cup. Because the lid is foldable in an upright direction, it does not interfere with such stacking action. The outer surface of the flat sidewall portion includes a writing surface. This is done either by affixing a label to the surface or by roughening the surface to accept ink or pencil lead. The bottom of the cup is inwardly concave which, in conjunction with the flat portion of the sidewall, reduces fluid movement during normal handling.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENTS

Figure 1:
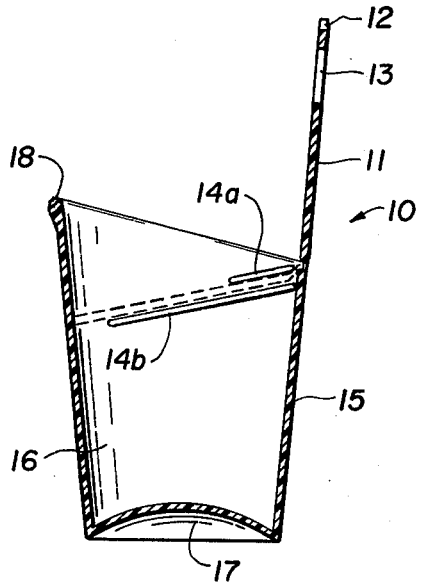
FIG. 1 is a vertical view, in section, of a cup according to the invention.
Figure 2:
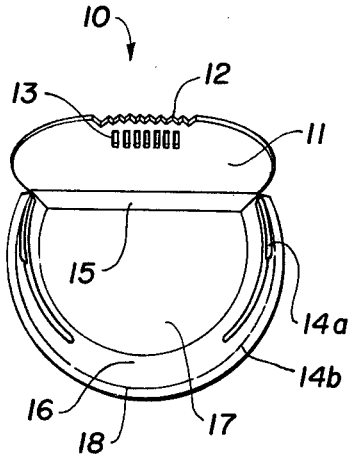
FIG. 2 is a plan view of the cup depicted in FIG. 1.
Figure 3:
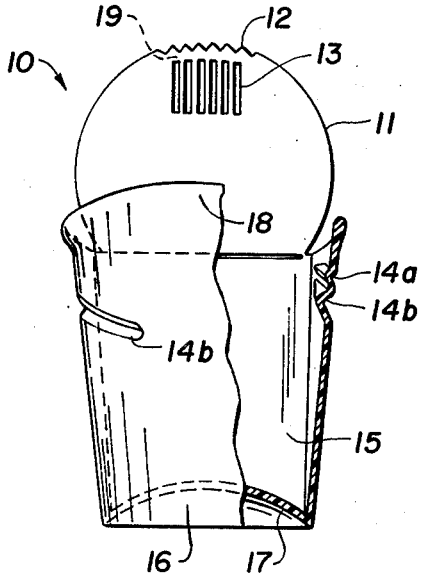
FIG. 3 is a front, vertical view, with portions broken away and in section.
Figure 9:
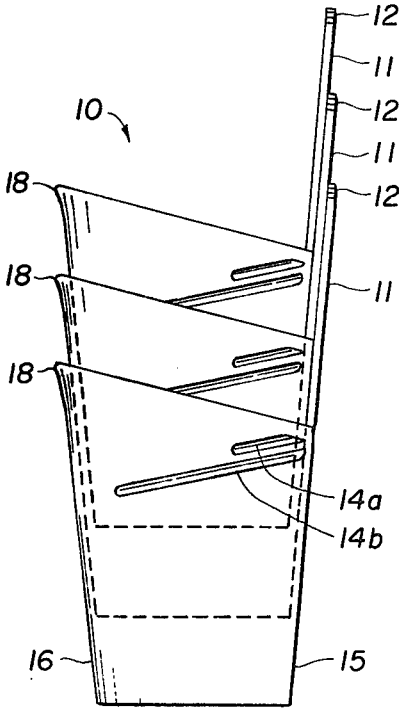
FIG. 9 is a side view, in elevation, of a nested stack of a plurality of the cups according to the invention.

Referring now more particularly to FIGS. 1, 2 and 3, the cup 10 is provided with a main sidewall portion 16 which is semicylindrical in configuration and which tapers inwardly from its upper edge to its lower edge as viewed in FIG. 1. Another portion of the sidewall 15 is flat and forms the back of the cup as viewed in the figures. The flat sidewall 15 also tapers inwardly from top to bottom. Thus, the diameter of the cup at the top is greater than the diameter at the bottom. This tapered configuration and the absence of an interior support shelf, such as in some prior art cups of this type, facilitates high density nesting or stacking of the cups as illustrated in FIG. 9. The flat sidewall portion 15 is integrally joined to the semicylindrical sidewall portion 16. The bottom of the cup is provided with a domed bottom 17 which is concave inwardly. The bottom 17 is integrally joined along its circumference to the bottom edges of the sidewall portions 15 and 16. The portion of the sidewall 16 which is opposite to the flat portion 15 is longer than the flat portion 15 to thereby form a pouring spout 18.

Figure 4:
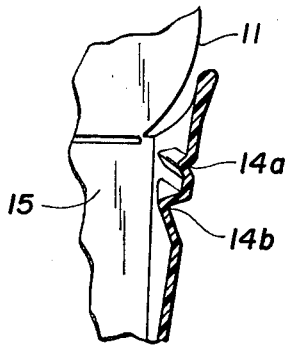
FIG. 4, is an enlarged, sectional view of the encircled detail depicted in FIG. 3.
Figure 5:
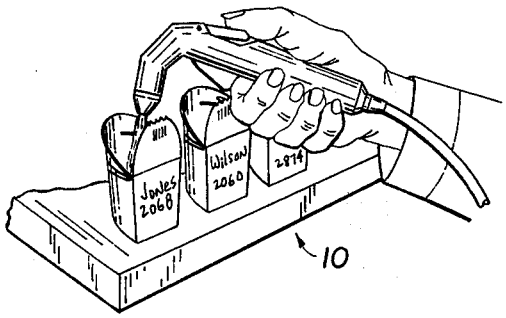
FIGS. 5, 6, 7 and 8 are illustrations demonstrating the use of the cup according to the invention.

A flat, semicircular lid 11 is integrally hinged to the topmost edge of the flat portion 15 as viewed in the Figures. The hinge is simply a scored web of the resilient material of which the cup is constructed. The lid can have reinforcing ridges (not shown) to prevent buckling of the lid on closure. The diameter of the lid 11 is such that when the lid is folded about the hinge line into the interior of the container by an angle of approximately 150°, the circumferential edge of the lid will abut the interior surface of the sidewall portion 16, and form a rudimentary seal therewith. As best viewed in FIGS. 3 and 4, the sidewall surface 16 is provided with a downwardly inclined, lower, indented ridge **14*b* and a parallel, upper indented ridge 14*a*, which are discontinuous at the spout region but which extend from the opposite ends of the upper edge of the flat portion through approximately a third of the way around the semicylindrical portion 16 of the sidewall. To close the cup, the lid 11 is folded to its inward position and pushed into engagement between the ridges 14*a* and 14*b*, to rigidly lock the lid 11** in the downward position. Since the lid, the sidewalls and the ridges are made of a resilient material the elastic deformation of these elements necessary to accomplish the locking step is easily accomplished.

The lid 11 is provided with a plurality of apertures 13 forming a grate which is located on a portion of the lid which is near the spout 18 when the lid is folded in the downward position. A plurality of saw-toothed recesses 12 are located in the edge of the lid 11 at that portion which is closest to the grate 13. It should be noted that both the recesses 12 and the grate 13 are located at the lowest point of the lid 11 when the lid is folded to the inward position and are aligned with the spout 18. The small portion of the lid which exists between the grate 13 and the recesses 12, as well as the grate surface, are suitable for supporting medication. This support surface 19 is on the upper surface of the lid when the lid is in the inwardly folded and locked position, and is therefore normally dry.

Figure 6:
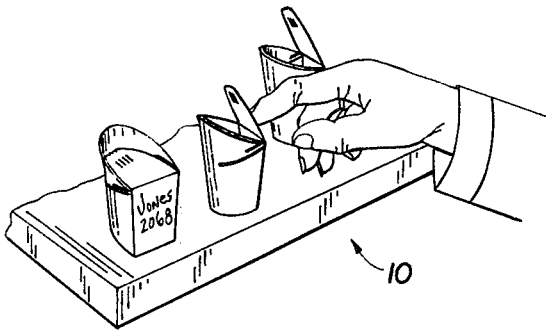
Figure 7:
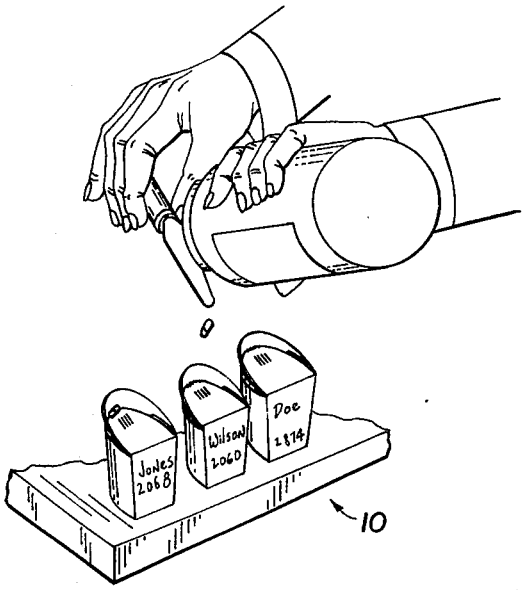

Referring now more particularly to FIGS. 5 - 8, the method of using the cup according to the invention is illustrated. The exterior of the flat sidewall portion 15 includes a writing surface 20. This writing surface can be simply a portion of the outer surface which is buffed or otherwise roughened so that a patient's name can be inscribed thereon with a ball point pen or pencil or the like. The lid in the open position is maintained vertically upward by the resilient properties of the hinge material. Once the lid is bent downwardly, the hinge deforms somewhat. Because the sidewall portions 15 and 16 are tapered and the lid is vertically upright, the cups may be conveniently stacked one inside another. At the time of use, the cups are unstacked, a given cup or plurality of cups are filled with water and the lids 10 are easily pushed inwardly, using only a single finger, into the container and are locked into position by engagement between the ridges **14*a* and 14*b*. This is best illustrated in FIGS. 6 and 7. Medication for the patient whose name appears on the rear of the flat surface 15 is then simply dropped on top of the lid. Since the lid is tilted downwardly, the medication will roll or slide over the grate 13 and will be held above the level of the liquid on the surface 19 and against the interior of the semicylindrical sidewall portion 16. There is little possiblity of the medication coming in contact with the water or other fluid within the cup, because the lid completely covers the upper open portion of the container formed by the sidewall portions 15 and 16. Moreover, since the lid was folded vertically upright when the cup was filled with water, the upper surface 19** was retained dry.

Figure 8:
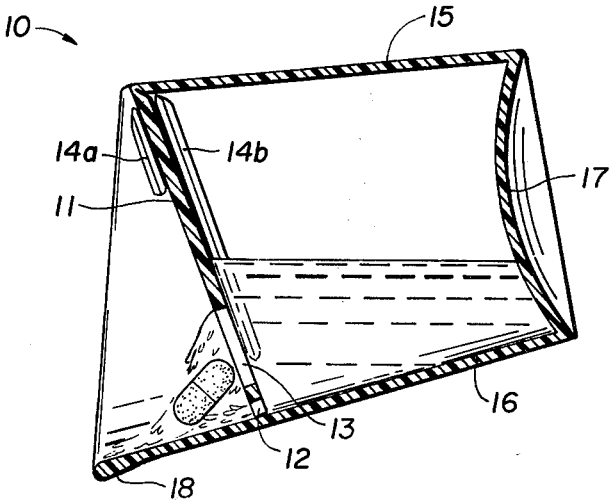

To use the cup, as illustrated in FIG. 8, the patient need merely tilt the cup and pour the fluid within the container out of the spout 18 into the patient's mouth. The fluid within the container cascades through the grate 13 to wet the medication while fluid simultaneously flows through the recesses 12 to carry the medication into the patient's mouth. It is important for the complete and easy ingestion of the medication that the medication be both wetted and carried into the patient's mouth simultaneously. If the medication is placed in the patient's mouth while the medication is dry, it has a tendency to stick to the patient's mouth or throat, in some instances, and is not washed down with the fluid. Wetting the medication as it is simultaneously carried into the patient's mouth obviates this problem.

The cup is vacuum formed and stamped polypropylene, however, in other embodiments, the cup could be made of other odorless, tasteless, and chemically stable materials suitable for use with pharmaceuitcal products. Similarly, other well known manufacturing techniques could be used to produce the cup.

While the embodiment depicted in the figures is the preferred embodiment for the reasons given above, this embodiment is more difficult to manufacture than other, less convenient to use embodiments, because the hinged lid requires a stamping operation along with the vacuum forming operation. For example, in one less preferred embodiment, the lid 11 is not hinged at the top edge of the flat portion 15, but is a separate, detached part. This allows the lids and cups to be made completely separately, resulting in less manufacturing cost. The separate lid is slid or pressed between a pair of vertically spaced apart ridges, corresponding to the ridges **14*a* and 14*b*, to close the cup. Such an embodiment, while easier to manufacture than the embodiment depicted in FIGS. 1–4**, has the disadvantage that it is more difficult to close the lid, over the cup opening. For example, the closing would require the use of both hands. There is also the possibility that a lid which is not completely inserted might allow the medication to drop into the fluid within the container.

It can thus be seen that the medication dispensing cup of the present invention is a significant advance in the area of patient comfort and drug administration. The cup allows for the simultaneous delivery of the medication and the liquid to the recipient, eliminating the usual time lag between dispensing of the pill and drinking. It also assists institutions in reducing manpower requirements while streamlining their drug control program. The cup is designed to be a sterile, single use cup which contains both the medication and the liquid required for administration. The flat back surface 15 not only provides an area for labeling the cup with the patient's name, the location and the amount of medical dosage or other information, but it also provides a natural way to hold the cup. It need not be turned to find the correct area to place against the patient's lip. The tablet support surface 19 enables the tablet or other dry medication to be dispensed from bulk containers without danger of contamination. In prior art devices of this type, it was necessary for someone to carefully locate the pill on a support surface within the cup which, in general, required that the medication be handled. In the present device, as best shown in FIG. 7, the medication can simply be dropped from a bulk container onto the closed lid without contact by human hands. Since the patient doesn't handle the dose, this lid feature also minimizes waste and theft. Moreover, the locking lid feature discourages refill or reuse.

While the cup has been described for use with a single tablet or capsule of medication, it should be apparent that it is also useful for simultaneously dispensing a plurality of capsules, tables or any other medication which is in a form which will not fall through the grate 13 or the recesses 12.

Still another advantage of the invention is that the domed bottom 17 in conjunction with the flat back surface 15 reduces fluid movement during normal handling, thereby minimizing the danger that fluid will be expelled prematurely through the grate 13 or the recesses 12. The tapered body of the cup makes the cup nestable to facilitate high density storage and handling. The raised lip or spout 18 ensures that the patient's nose does not interfere with the administration of the dose.

The terms and expressions which have been employed here are used as terms of description and not of limitation, and there is no intention, in the use of such terms and expressions, of excluding equivalents of the features shown and described, or portions thereof, it being recognized that various modifications are possible within the scope of the invention claimed.

What is claimed is:

1. A cup for simultaneously dispensing medication along with a liquid, the cup comprising a bottom, a sidewall, the bottom and the sidewall being integrally joined together to constitute a fluid holding container which is open at its top, and a lid to cover the open top of the container, the lid having at least one aperture therein which is smaller than the size of the medication to permit the passage of fluid from the container therethrough while preventing the medication from passing into the container, and a dry, medication support surface adjacent to the aperture and exterior to the container, hinge means for attaching the lid to the open top of the container at an angle which is downward when the cup is positioned vertically upright so that the medication rests against the cup's sidewall as well as upon the surface of the lid, and means for locking the lid in a position which closes the container top which is diametrically opposite to the sidewall flat portion being tilted downwardly when the cup is positioned vertically upright.

2. A cup as recited in claim 1, wherein the lid aperture is adjacent a selected portion of the lid's edge and the selected portion of the lid's edge is provided with at least one recess, and wherein the medication support surface of the lid is located adjacent the lid aperture and the recess in the edge.

3. A cup as recited in claim 1, wherein the sidewall is tapered inwardly from the top toward the bottom to render the cup nestable within other such cups.

4. A cup as recited in claim 3, wherein the sidewall includes a semicylindrical portion and at integrally joined flat portion.

5. A cup as recited in claim 4, wherein the surface of the sidewall flat portion which is exterior with respect to the container includes a writing surface.

6. A cup as recited in claim 4, wherein the lid is hinged to the upper edge of the sidewall flat portion.

7. A cup as recited in claim 1, wherein that portion of the sidewall which is closest to the lid aperture is longer than the diametrically opposite portion of the sidewall to thereby form a pouring spout.

8. A cup as recited in claim 1, wherein the sidewall has both a semicylindrical portion and a flat portion, with both portions tapering inwardly toward the bottom, the lid is hinged to the flat portion, and means are provided for locking the lid in a closed position with the portion of the lid edge which is diametrically opposite to the sidewall flat portion being tilted downwardly when the cup is positioned vertically upright.

9. A cup as recited in claim 1, wherein the bottom is inwardly concave.

* * * * *